US011319772B2

(12) United States Patent
Walton et al.

(10) Patent No.: US 11,319,772 B2
(45) Date of Patent: May 3, 2022

(54) ELIMINATION OF PEROFRATION PROCESS IN PLUG AND PERF WITH DOWNHOLE ELECTRONIC SLEEVES

(71) Applicant: Halliburton Energy Services, Inc., Houston, TX (US)

(72) Inventors: Zachary William Walton, Carrollton, TX (US); Michael Linley Fripp, Carrollton, TX (US); Matthew James Merron, Carrollton, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/315,591

(22) PCT Filed: Jul. 15, 2016

(86) PCT No.: PCT/US2016/042468
§ 371 (c)(1),
(2) Date: Jan. 4, 2019

(87) PCT Pub. No.: WO2018/013131
PCT Pub. Date: Jan. 18, 2018

(65) Prior Publication Data

US 2019/0234179 A1 Aug. 1, 2019

(51) Int. Cl.
*E21B 34/06* (2006.01)
*E21B 29/02* (2006.01)
(Continued)

(52) U.S. Cl.
CPC ..... *E21B 34/06* (2013.01); *E21B 29/02* (2013.01); *E21B 34/14* (2013.01); *E21B 43/14* (2013.01);
(Continued)

(58) Field of Classification Search
CPC ..... E21B 34/06; E21B 34/14; E21B 34/142; E21B 34/10; E21B 29/02; E21B 47/12;
(Continued)

(56) References Cited

U.S. PATENT DOCUMENTS 5,959,547 A * 9/1999 Tubel ..... E21B 33/1275 340/853.2
7,740,079 B2 6/2010 Clayton et al.
(Continued)

FOREIGN PATENT DOCUMENTS

WO 2014189766 A2 11/2014
WO 2017027978 A1 2/2017

OTHER PUBLICATIONS

French Search Report dated Feb. 17, 2020, French Application No. 1755292.
(Continued)

*Primary Examiner* — George S Gray
(74) *Attorney, Agent, or Firm* — McGuireWoods LLP

(57) ABSTRACT

A method includes positioning a completion assembly in a wellbore penetrating a subterranean formation and conveying a frac plug through the completion assembly. The completion assembly may provide a fracturing assembly. The method further includes detecting a wireless signal provided by the frac plug with a sensor included in the fracturing assembly, actuating a sliding sleeve of the fracturing assembly based on detection of the wireless signal and thereby moving the sliding sleeve to expose one or more flow ports, setting the frac plug in the wellbore downhole from the fracturing assembly, conveying a wellbore projectile through the completion assembly, receiving the wellbore projectile with the frac plug, and thereby sealing the wellbore at the frac plug, and injecting a fluid under pressure into the subterranean formation via the one or more flow ports.

20 Claims, 7 Drawing Sheets

(51) Int. Cl.

| | |
|---|---|
| ***E21B 34/14*** | (2006.01) |
| ***E21B 43/14*** | (2006.01) |
| ***E21B 43/26*** | (2006.01) |
| ***E21B 47/12*** | (2012.01) |
| *E21B 33/12* | (2006.01) |

(52) U.S. Cl.
CPC ..... *E21B 43/26* (2013.01); *E21B 47/12* (2013.01); *E21B 33/12* (2013.01); *E21B 2200/06* (2020.05)

(58) Field of Classification Search
CPC ..... E21B 43/14; E21B 43/26; E21B 43/17; E21B 43/2605; E21B 43/2607; E21B 43/27; E21B 2200/06; E21B 33/12; E21B 33/00; E21B 33/129; E21B 17/00; E21B 23/06; E21B 44/06; E21B 21/08; E21B 21/00; E21B 21/082; E21B 21/085
See application file for complete search history.

(56) References Cited

U.S. PATENT DOCUMENTS

| | | | | |
|---|---|---|---|---|
| 8,127,856 | B1 | 3/2012 | Nish et al. | |
| 8,616,276 | B2 | 12/2013 | Tips et al. | |
| 8,646,537 | B2 | 2/2014 | Tips et al. | |
| 8,757,274 | B2 | 6/2014 | Skinner et al. | |
| 9,004,185 | B2 | 4/2015 | Madero et al. | |
| 9,010,448 | B2 | 4/2015 | Williamson, Jr. et al. | |
| 9,016,387 | B2 | 4/2015 | Williamson, Jr. et al. | |
| 9,080,420 | B2 | 7/2015 | Flores et al. | |
| 9,359,877 | B2 | 6/2016 | Stout | |
| 2009/0084553 | A1 | 4/2009 | Rytlewski et al. | |
| 2009/0223663 | A1 | 9/2009 | Snider et al. | |
| 2011/0315403 | A1 | 12/2011 | Nard et al. | |
| 2013/0048290 | A1 | 2/2013 | Howell et al. | |
| 2013/0220603 | A1* | 8/2013 | Robison | E21B 34/14 166/250.04 |
| 2014/0190685 | A1* | 7/2014 | Frazier | E21B 33/1293 166/250.01 |
| 2014/0262234 | A1* | 9/2014 | Walton | E21B 34/06 166/250.01 |
| 2014/0262236 | A1 | 9/2014 | Walton et al. | |
| 2014/0345878 | A1* | 11/2014 | Murphree | C09K 8/703 166/377 |
| 2015/0096767 | A1 | 4/2015 | Atilano et al. | |
| 2015/0159463 | A1 | 6/2015 | Frazier | |
| 2015/0247375 | A1 | 9/2015 | Stout | |
| 2015/0260038 | A1 | 9/2015 | Algouhi | |
| 2016/0047205 | A1 | 2/2016 | Head | |
| 2016/0061002 | A1 | 3/2016 | Kennedy | |
| 2016/0115776 | A1 | 4/2016 | Haci | |
| 2017/0335678 | A1* | 11/2017 | Ciezobka | E21B 33/12 |
| 2018/0216455 | A1* | 8/2018 | Andreychuk | E21B 43/26 |

OTHER PUBLICATIONS

Halliburton, "Halliburton's RapidFracTM" lien URL: https://www.youtube.com/watch?v=KpVGfGYiF1w published Apr. 3, 2013.
Denmark Search Report dated Feb. 25, 2020, Denmark Application No. PA201800957.
International Search Report and Written Opinion dated Apr. 14, 2017; International PCT Application No. PCT/US2016/042468.

* cited by examiner

ELIMINATION OF PEROFRATION PROCESS IN PLUG AND PERF WITH DOWNHOLE ELECTRONIC SLEEVES

BACKGROUND

Hydrocarbon-producing wells are often stimulated by hydraulic fracturing operations in order to enhance the production of hydrocarbons present in subterranean formations. During a typical fracturing operation, a servicing fluid (i.e., a fracturing fluid or a perforating fluid) may be injected into a subterranean formation penetrated by a wellbore at a hydraulic pressure sufficient to create or enhance a network of fractures within the subterranean formation. The resulting fractures serve to increase the conductivity potential for extracting hydrocarbons from the subterranean formation.

In some wellbores, it may be desirable to selectively generate multiple fracture networks along the wellbore at predetermined distances apart from each other, thereby creating multiple interval "pay zones" in the subterranean formation. Each pay zone may include a fracturing assembly used to initiate and carry out the hydraulic fracturing operation. Following the hydraulic fracturing operation, the fracturing assemblies are closed and corresponding production assemblies are operated to extract hydrocarbons from the various pay zones and convey the hydrocarbons to the well surface for collection.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present disclosure relates generally to eliminating the perforation process in a traditional "plug and perf" operation. As disclosed herein, a completion assembly including multiple fracturing assemblies is installed in a wellbore to create multiple production intervals. Each fracturing assembly includes at least one sliding sleeve that is actuated to move to an open position using a wireless signal or a digital code obtained from a fracturing ("frac") plug conveyed into the wellbore.

Figure 1:
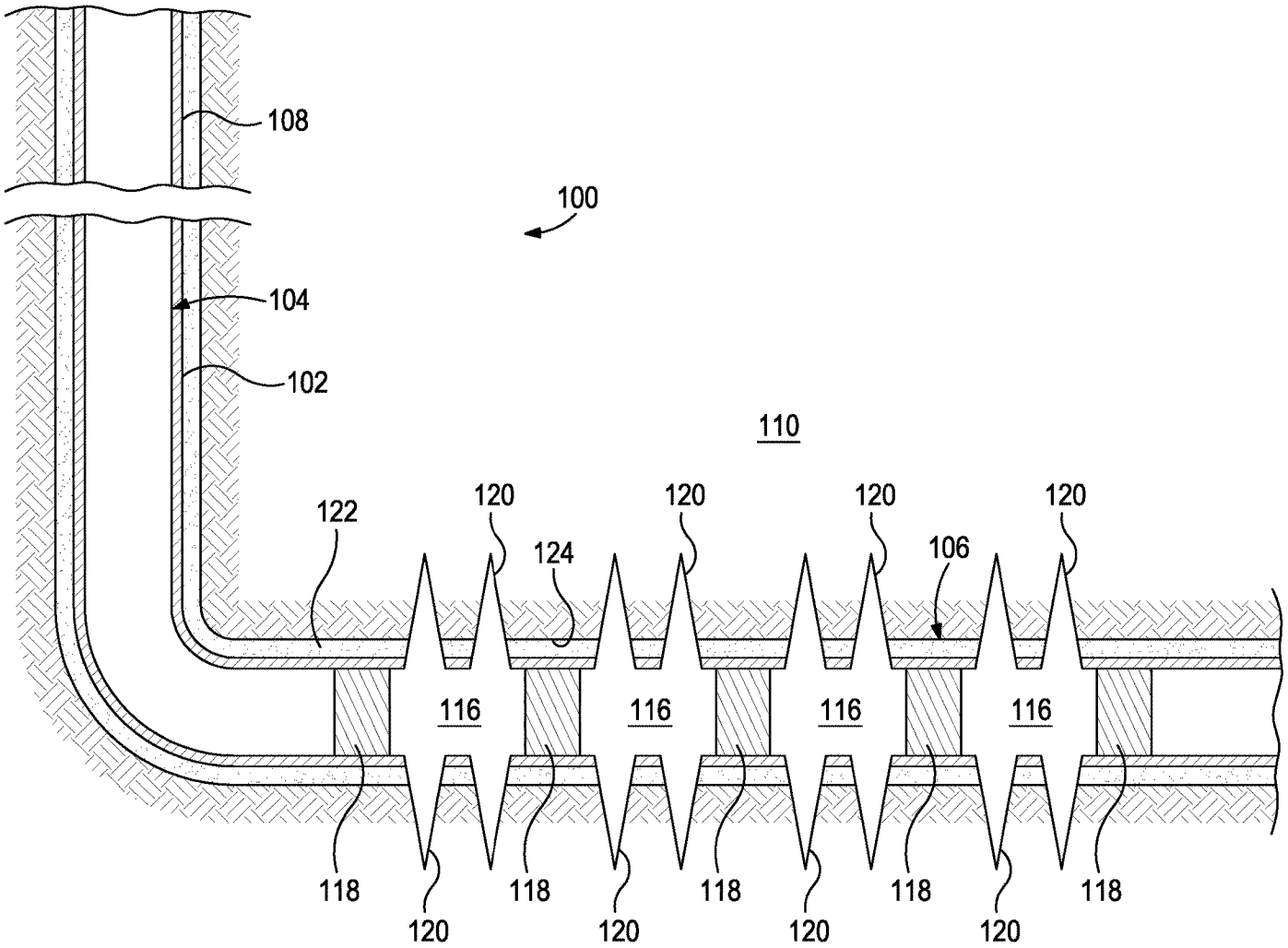
FIG. 1 is a well system that may employ the principles of the present disclosure.

FIG. 1 is an example well system 100 that may employ the principles of the present disclosure, according to one or more embodiments of the disclosure. As depicted, the well system 100 includes a wellbore 102 that extends through various earth strata and has a substantially vertical section 104 that transitions into a substantially horizontal section 106. The vertical section 104 and the horizontal section 106 are lined with a string of casing 108 that is secured in the wellbore 102 by pumping cement 122 in the annulus 124 defined between the casing 108 and the wellbore 102. The horizontal section 106 may extend through one or more hydrocarbon bearing subterranean formations 110.

Multiple plug and perforation operations may be undertaken in the horizontal section 106 of the wellbore 102 in preparation for subsequent hydraulic fracturing operations. To accomplish this, a series of frac plugs 118 may be sequentially installed in the horizontal section 106 starting at the bottom or "toe" of the wellbore 102 and working uphole to define multiple production intervals 116 between axially adjacent frac plugs 118. After installing each frac plug 118, the wellbore 102 will be perforated a short distance uphole from the installed frac plug 118.

Figure 2:
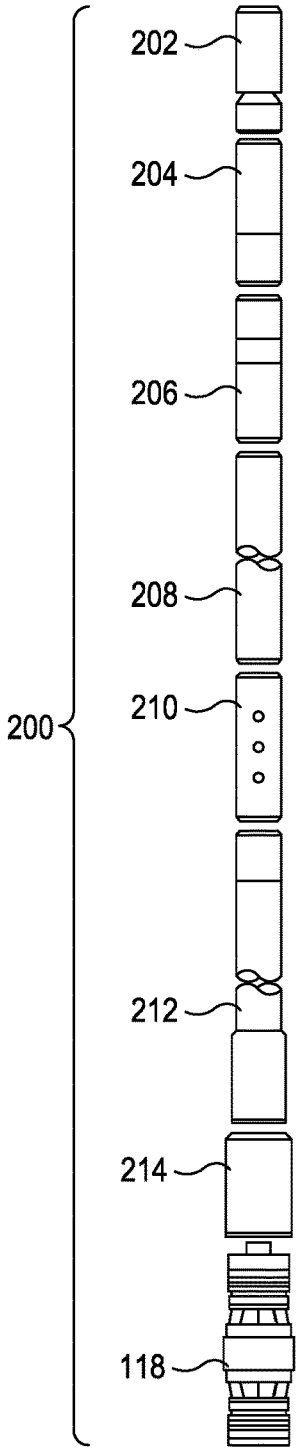
FIG. 2 illustrates a bottom hole assembly (BHA) typically used in a perf and plug operation.

FIG. 2 schematically illustrates a bottom hole assembly (BHA) 200 used in a typical perf and plug operation. As illustrated, the BHA 200 may include a connector 202 at the uphole end thereof for coupling the BHA 200 to a conveyance such as coiled tubing, jointed pipe, wireline, and the like. For example, the connector 202 may be a coiled tubing connector for coupling the BHA to coiled tubing for conveying into the wellbore 102. Downhole from the connector 202, the BHA may include a flapper valve 204, a hydraulic disconnect 206, an eccentric weight bar or sub 208, and a perforating gun 210. Beneath the perforating gun 210, the BHA 200 may include a setting tool 212 and an adapter 214. The frac plug 118 may be connected to the adapter 214. It will be understood that the BHA 200 is only an example of the type of tools and components that may be combined in a BHA. The number and type of tools and connectors will vary widely depending on the well and the nature of the operations to be performed.

The BHA 200 may be run downhole into the wellbore 102 (FIG. 1) until the frac plug 118 is positioned at a desired location in the horizontal section 106. The setting tool 212 is actuated to secure the frac plug 118 in the horizontal section 106. For instance, the setting tool 212 may actuate one or more expandable devices such as an expandable wellbore packer on the outer surface of the frac plug 118 to expand radially outward to seal against the inner wall of the casing 108. Once the frac plug 118 has been set, the adapter 214 may be decoupled from the frac plug 118 and the BHA 200 (excluding the frac plug 118) may be pulled uphole a desired distance from the frac plug 118. The perforating gun 210 is then triggered to fire shaped charges that pierce the casing 108 and penetrate some distance past the casing 108 into the annulus 124 and the formation 110. This creates perforations in the casing 108 for providing a fluidic communication between the formation 110 and the interior of the casing 108 via the annulus 124. Once the formation 110 is accessed, the BHA 200 (excluding the frac plug 118) is removed from the wellbore 102.

A wellbore projectile, such as a ball, a dart, or a plug, may then be dropped from the well surface location and pumped to the frac plug 118. The wellbore projectile is received by the frac plug 118 to seal the wellbore 102 at the frac plug 118 and thereby isolate portions of the wellbore 102 downhole from the frac plug 118. The wellbore projectile may be displaced into the horizontal section 106 by any technique. For example, the wellbore projectile can be dropped through the casing 108 (FIG. 1), pumped by flowing fluid through the casing 108, self-propelled, conveyed by wireline, slickline, coiled tubing, or the like, and any combination thereof.

Once the wellbore projectile seals against the frac plug 118, a fracturing fluid (e.g., a mixture of proppant and clean fluid) is then pumped downhole at high pressure and injected into the surrounding formation 110 through the perforations created in the casing 108. The high-pressure fracturing fluid hydraulically fractures the surrounding formation 110 and generates fractures 120 (FIG. 1) that extend radially outward from the wellbore 102. Once the fracturing operation is complete, the BHA 200 is assembled with a second frac plug 118 and conveyed downhole to install the second frac plug 118 a desired distance uphole from the first frac plug 118, and thereby defining a production interval 116 between the two axially adjacent frac plugs 118. Once the second frac plug 118 is installed, the hydraulic fracturing process is repeated until a desired number of production intervals 116 are fractured and isolated with frac plugs 118.

Thereafter, a drilling assembly including a drill bit at the distal end thereof is run downhole to drill out all the frac plugs 118 thereby allowing full access to the surrounding formation 110. It should be noted that, even though FIG. 1 depicts multiple production intervals 116 separated by the frac plugs 118, the horizontal section 106 may provide any number of production intervals 116 with a corresponding number of frac plugs 118 arranged therein. It should also be noted that, although the production intervals 116 are shown in the same formation 110, some of the production intervals 116 may lie in a different formation.

In order to reduce the number of well interventions required to place the frac plugs 118 using the traditional plug and perf operation and, thereby reduce the costs and time required to prepare the well for hydraulic fracturing operations, embodiments disclosed herein are directed to assessing the surrounding formation 110 without performing the perforating process included in the traditional plug and perf operation. Additionally, elimination of the perforating process creates a safer operating environment since explosives no longer used. Herein, a completion assembly including multiple sliding sleeves is installed in the horizontal section 106 and the sliding sleeves may be positioned in the completion assembly adjacent portions of the formation 110 that are to be hydraulically fractured. Instead, of conveying perforation guns downhole to penetrate the casing 108, the sliding sleeves may be wirelessly actuated using frac plugs to expose flow ports defined in the completion assembly. In some embodiments, the sliding sleeves may each include electronics designed to read wireless signals passed through them and, each time a signal is detected the hardware/firmware included in the electronics will register a count. Once a programmed count is reached, the sliding sleeve will actuate and open to expose the flow ports in preparation for hydraulic fracturing operations.

Figure 3:
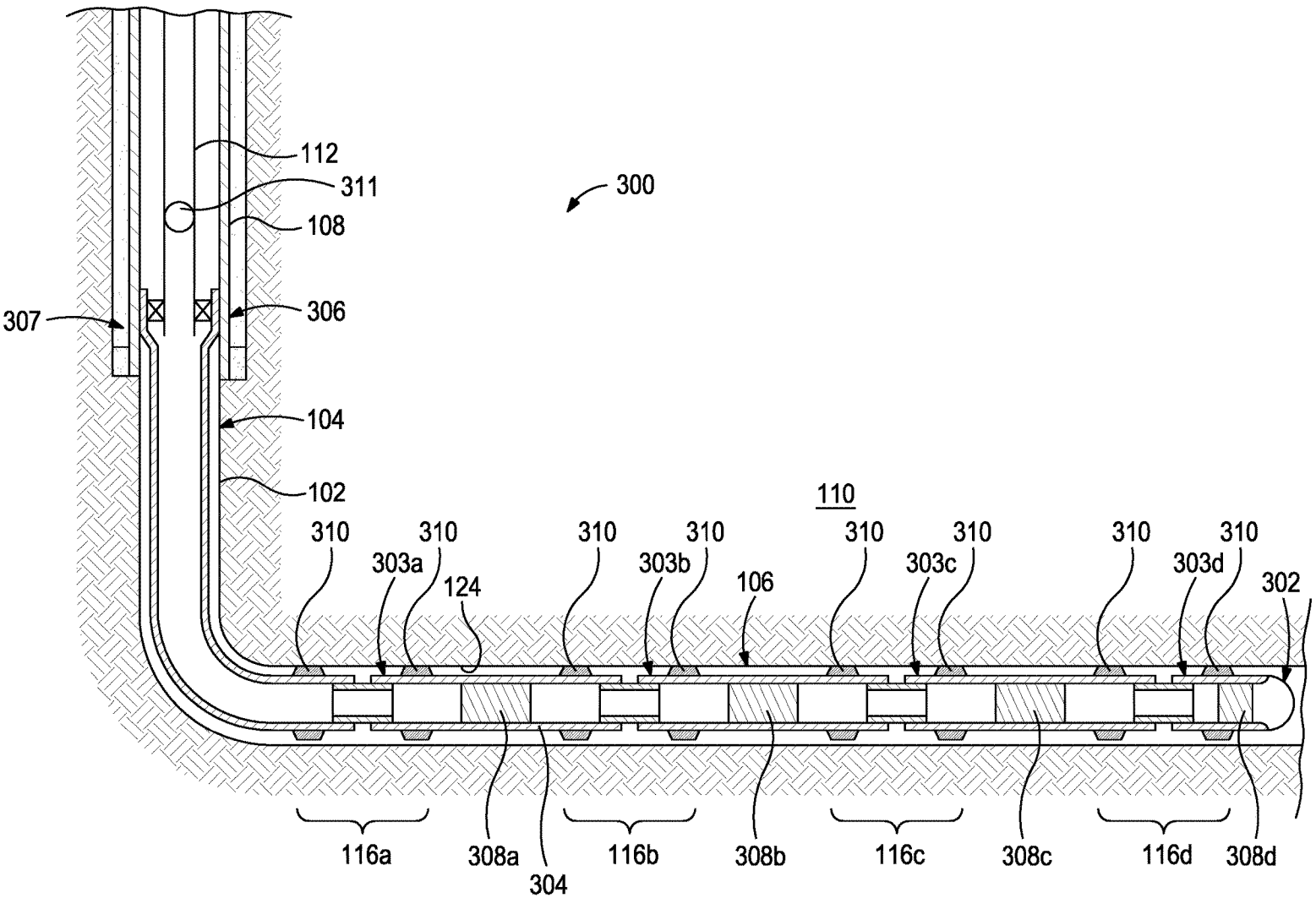
FIG. 3 is a cross-sectional side view of the well system including a completion assembly extended into the horizontal section.

FIG. 3 is a cross-sectional side view of another example well system 300 that may employ the principles of the present disclosure, according to one or more embodiments of the disclosure. The well system 300 may be similar in some respects to the well system 100 in FIG. 1, and therefore may be best understood with reference thereto where like numerals designate like components not described again in detail. In the well system 300, the upper portion of the vertical section 104 may be lined with the casing 108 cemented therein to support the wellbore 102, while the rest of the wellbore 102 may be "open hole." The casing 108 may extend from a surface location, such as the Earth's surface, or from an intermediate point between the surface location and the formation 110.

A completion assembly 302 may be extended into the horizontal section 106 and may include a liner 304 secured to or otherwise "hung off" the casing 108. More particularly, the liner 304 may include a liner hanger 306 coupled to a distal end 307 of the casing 108. The liner hanger 306 may include various seals or packers (not shown) configured to seal against the inner wall of the casing 108 and thereby provide a sealed interface that effectively extends the axial length of the casing 108 into the horizontal section 106. At its uphole end, the completion assembly 302 may be coupled to the end of a work string 112 that is extended into the wellbore 102 from the surface location.

The completion assembly 302 may also include various downhole tools and devices used to prepare the horizontal section 106 for the subsequent extraction of hydrocarbons from the surrounding formation 110. For example, the completion assembly 302 may include a plurality of wellbore isolation devices 310 (alternately referred to as "packers") that isolate the various production intervals 116 (individually shown as production intervals 116*a-d*) in the horizontal section 106. More particularly, each production interval 116*a-d* includes upper and lower wellbore isolation devices 310 configured to seal against the inner wall of the horizontal section 106 and thereby provide fluid isolation between axially adjacent production intervals 116*a-d*.

Each production interval 116*a-d* may further include at least one fracturing assembly, illustrated as fracturing assemblies 303*a-d* (collectively referred to as fracturing assemblies 303), positioned within the liner 304. Each fracturing assembly 303*a-d* may be actuatable or otherwise operable to facilitate the injection of a fluid (e.g., a fracturing fluid) into the annulus 124 defined between the completion assembly 302 and the wellbore 102, and thereby create the network of fractures 120 (FIG. 1) in the surrounding formation 110. The fluid may also or alternatively comprise a gravel slurry that fills the annulus 124 following the creation of the fractures 120. In yet other applications, the fluid injected at the fracturing assemblies 303 may comprise a stimulation fluid, a treatment fluid, an acidizing fluid, a conformance fluid, or any combination of the foregoing fluids.

As illustrated, the completion assembly 302 may further include one or more frac plugs 308*a-d* (collectively referred to as frac plugs 308), each installed (or set) in the liner 304 downhole from a corresponding production interval 116*a-d*. The frac plugs 308 may be conveyed into the wellbore 102 on a conveyance that does not include a perforating gun or similar device used for perforating the casing 108. Once reaching a predetermined location within the wellbore 102, each frac plug 308 may be set within the wellbore 102 using conventional setting techniques. As described below, the frac plugs 308*a-d* may be used to actuate or otherwise operate one or more of the fracturing assemblies 303 to expose one or more flow ports defined in the completion assembly 302.

In some embodiments, the frac plugs 308 may have a cylindrical body including a mandrel that defines a longitudinal central flow passage. One or more sets of slips wedges are positioned circumferentially about the mandrel, and a packer assembly consisting of one or more expandable or inflatable packer elements may be disposed between (axially interpose) the slip wedges. Once the frac plug 308 reaches the target location, a setting tool (e.g., the setting tool 212 of the BHA 200 in FIG. 2) can be utilized to move the frac plug 308 from its unset position to a set position. The setting tool may operate via various mechanisms to anchor the frac plug 308 in the wellbore 102 including, but not limited to, hydraulic setting, mechanical setting, setting by swelling, setting by inflation, and the like. In the set position, the slips and the packer elements expand and engage the inner walls of the completion assembly 302 to anchor the frac plug 308 within the wellbore 102.

A wellbore projectile 311 (e.g., a ball, a dart, a plug, etc.) may then be conveyed downhole from the well surface location after installation of each frac plug 308. The wellbore projectile 311 may be sized and otherwise configured to be received by a corresponding one of the frac plugs 308 and thereby isolate portions of the wellbore 102 downhole from the given frac plug 308.

It should be noted that even though FIG. 3 depicts the completion assembly 302 as being arranged in an open hole portion of the wellbore 102, embodiments are contemplated wherein at least a portion of the completion assembly 302 is arranged within a cased portion of the wellbore 102. Moreover, even though FIG. 3 depicts multiple production intervals 116 separated by the wellbore packers 310, the completion assembly 302 may provide any number of production intervals 116 with a corresponding number of wellbore packers 310 arranged therein. In other embodiments, the wellbore packers 310 may be entirely omitted from the completion assembly 302 and cement may be used instead to isolate the various production intervals 116, without departing from the scope of the disclosure.

In addition, while FIG. 3 depicts the completion assembly 302 as being arranged in a generally horizontal section 106 of the wellbore 102, the completion assembly 302 is equally well suited for use in other directional configurations including vertical, deviated, slanted, or any combination thereof. The use of directional terms herein such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 4A:
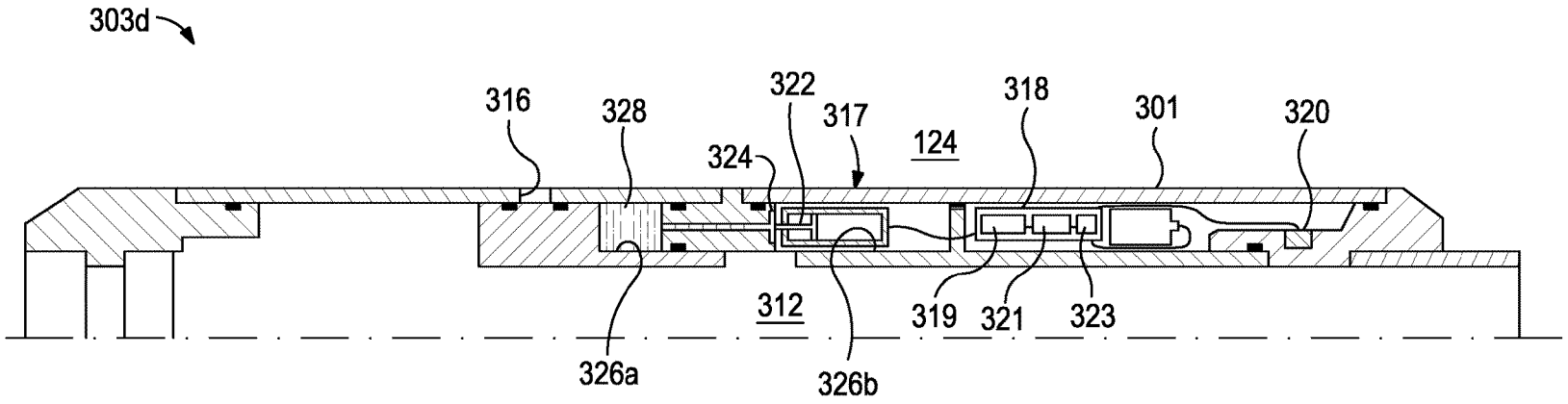
FIGS. 4A, 4B, and 4C are progressive cross-sectional side views of an example fracturing assembly.
Figure 4B:
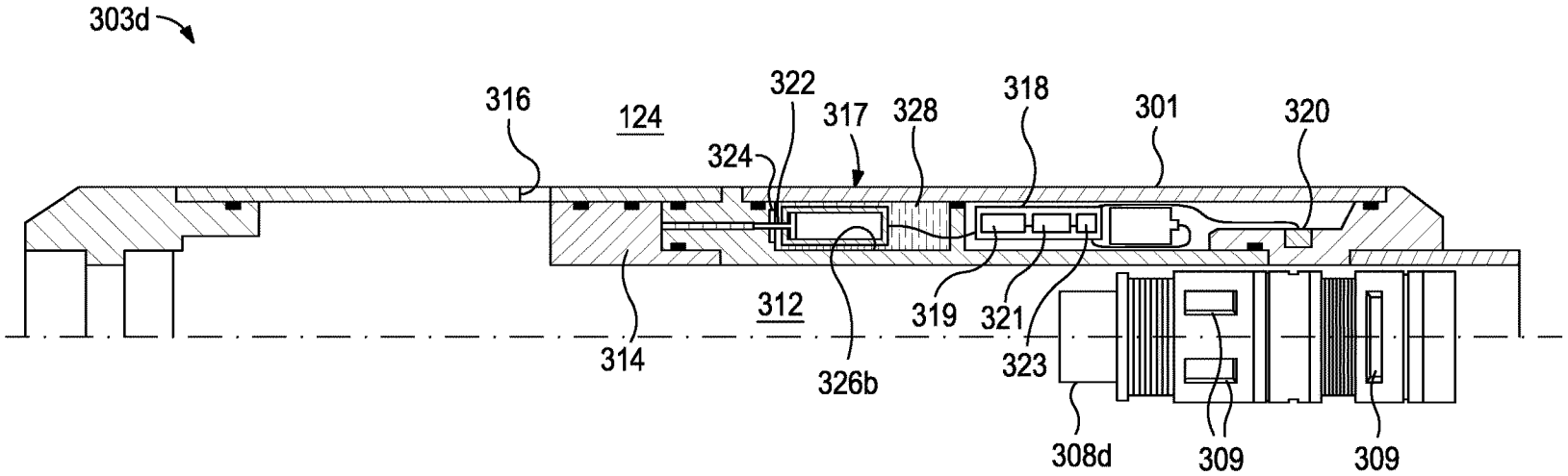
Figure 4C:
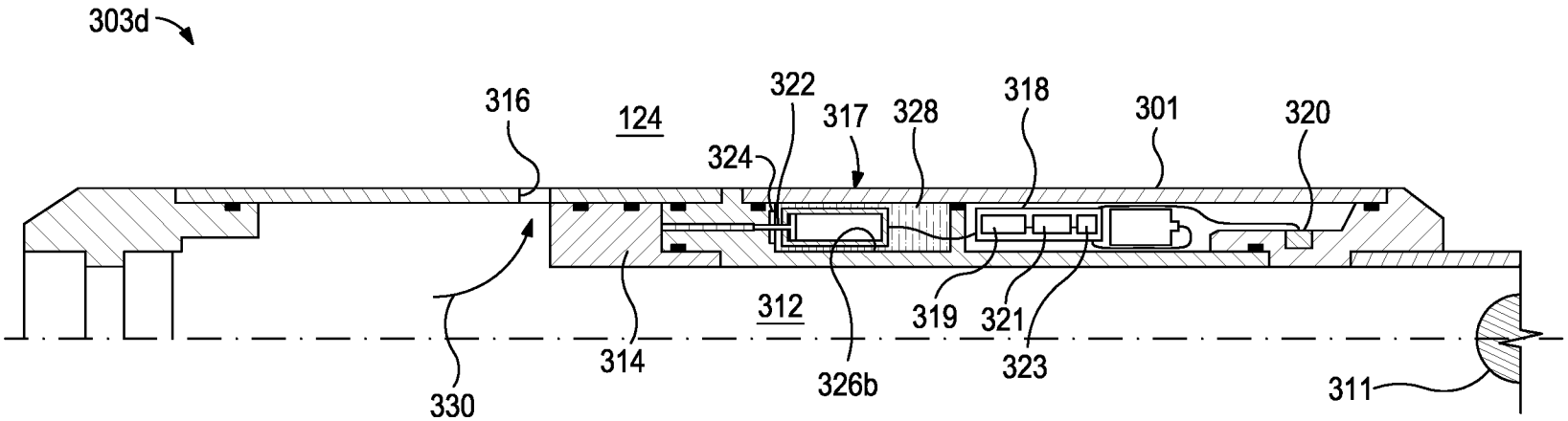

FIGS. 4A, 4B, and 4C are progressive cross-sectional side views of an example fracturing assembly 303*d* during example operation, according to one or more embodiments. Although described with reference to the fracturing assembly 303*d*, the fracturing assemblies 303*a-c* may be similar to or the same as the fracturing assembly 303*d*. Referring to FIG. 4A, the fracturing assembly 303*d* is depicted as including a housing 301 that defines a central flow passage 312. The housing 301 may form an integral part of the completion assembly 302 (FIG. 3), such as being coupled between opposing lengths of the liner 304 (FIG. 3). As a result, the central flow passage 312 may be in fluid communication with the work string 112 (FIG. 3) such that fluids and objects conveyed into the wellbore 102 (FIG. 1) through the work string 112 will eventually flow into the liner 304 and the central flow passage 312.

The fracturing assembly 303*d* may further include a sliding sleeve 314 positioned for longitudinal (axial) movement within the central flow passage 312. One or more flow ports 316 (one shown) are defined in the wall of the housing 301 and are blocked (occluded) when the sliding sleeve 314 is in a first or "closed" position. With the sliding sleeve 314 in the closed position, as shown in FIG. 4A, fluid communication is prevented between the annulus 124 external to the fracturing assembly 303*d* and the central flow passage 312. As described below, however, the sliding sleeve 314 is actuatable to move (i.e., displace) to a second or "open" position where the flow ports 316 are exposed.

To move the sliding sleeve 314 to the open position, an actuator 317 is triggered based on a wireless signal received or otherwise detected by a sensor 320. The sensor 320 may comprise a variety of types of downhole sensors configured to detect or otherwise receive a variety of wireless signals. In some embodiments, the sensor 320 may comprise a magnetic sensor configured to detect the presence of a magnetic field or property produced by one or more downhole tools conveyed through the central flow passage 312 in the completion assembly 302. For instance, the downhole tools may comprise one or more of the frac plugs 308*a-d* (FIG. 3) that are conveyed through the central flow passage 312 during installation and the frac plugs 308*a-d* may exhibit or emit a magnetic field or property detectable by the sensor 320. Alternatively, in other examples, the downhole tools may exhibit or emit the magnetic field or property detectable by the sensor 320. In such embodiments, the sensor 320 may comprise a magneto-resistive sensor, a Hall-effect sensor, a conductive coil, or any combination thereof. In some embodiments, one or more permanent magnets can be combined with the sensor 320 to create a magnetic field that is disturbed by a frac plug, and a detected change in the magnetic field can be an indication of the presence of the frac plug.

However, the sensor 320 may be configured to detect other types of wireless signals provided by the frac plugs 308*a-d* (FIG. 3) such as, but not limited to, an electromagnetic signal, temperature, or noise (acoustics). Consequently, the sensor 320 may comprise at least one of an antenna, a temperature sensor, an acoustic sensor, or a radio frequency identification (RFID) reader. When comprising an RFID reader, the sensor 320 detects electromagnetic signals (or fields) generated by RFID tags attached to the frac plugs 308*a-d* conveyed through the central flow passage 312. Alternatively, the sensor 320 may comprise a near field communication (NFC) device that communicates with other NFC devices coupled to the frac plugs 308*a-d* using the NFC communication protocol.

The sensor 320 is communicably connected to an electronics module 318 that includes electronic circuitry configured to determine whether the sensor 320 has detected a particular (or unique) wireless signal. The electronics module 318 may also include an electronic counter 319 configured to register a count each time the sensor 320 has detected a particular wireless signal. For instance, the electronic counter 319 may increase or decrease the count by 1 (or by any desired interval) each time the sensor 320 detects the presence of a magnetic field or property produced by the frac plugs 308*a-d* conveyed through the central flow passage 312. Alternatively, in other embodiments, the sensor 320 may be absent and the particular wireless signal may be detected directly by the electronic circuitry.

The electronics module 318 may also include a power supply, such as one or more batteries, a fuel cell, a downhole generator, or any other source of electrical power. The power supply may be used to power operation of one or more of the electronics module 318, the sensor 320, and the actuator 317. Although not illustrated explicitly, the electronic circuitry may include a controller configured to control one or more operations of the electronics module 318. The controller may operate based on instructions stored in a memory device communicably coupled thereto.

In embodiments where the sensor 320 is a magnetic sensor, the electronic circuitry may be configured to determine whether the sensor 320 has detected a predetermined magnetic field, a pattern or combination of magnetic fields, or another magnetic property of the frac plugs 308*a-d*. The electronic counter 319 may be configured to register the count each time the sensor 320 positively detects the predetermined magnetic field, the pattern or combination of magnetic fields, or another magnetic property. In some embodiments, the electronics module 318 may include predetermined magnetic field(s) or other magnetic properties programmed into a non-volatile memory 321 for comparison to magnetic fields/properties detected by the sensor 320.

In embodiments where the sensor 320 is a temperature sensor, the electronics module 318 could include a predetermined temperature level programmed into the memory 321 for comparison against the real-time temperature changes detected by the sensor 320. In this case, the electronic counter 319 may register the count each time the sensor 320 detects the temperature changes. In embodiments where the sensor 320 is an acoustic sensor, the electronics module 318 could include predetermined acoustic signatures or acoustic sequences programmed into the memory 321 for comparison against noises or a series (pattern) of noise changes detected by the sensor 320. In this case, the electronic counter 319 may register the count each time the sensor 320 detects the noises or the series (pattern) of noise changes.

In embodiments where the sensor 320 is an RFID reader, the electronic circuitry may be configured to detect electromagnetic signals (or fields) to identify and track RFID tags attached to the frac plugs 308*a-d* and the electronic counter 319 may be configured to register the count each time the sensor 320 has detected the electromagnetic signal from an RFID tag. In this instance, the electronics module 318 could include information that identifies the frac plugs 308*a-d* (or differentiates the frac plugs 308*a-d* from other wellbore tools) present in the central flow passage 312.

In embodiments where the sensor 320 is an NFC device, the electronic circuitry may be configured to detect NFC signals transmitted by other NFC devices attached to the frac plugs 308*a-d* and the electronic counter 319 may be configured to register the count each time the sensor 320 has detected an NFC signal from an NFC device attached to a frac plug 308*a-d*. In this instance, the electronics module 318 could include information that identifies the frac plugs 308*a-d* (or differentiates the frac plugs 308*a-d* from other wellbore tools) present in the central flow passage 312.

The electronic module 318 may also include a predetermined count programmed into the memory 321 for comparison against the count registered by the electronic counter 319. As described in more detail below, the count programmed into the memory 321 may depend on the location of the fracturing assembly 303*a-d* in the wellbore 102.

The process of actuating the sliding sleeve 314 of the fourth fracturing assembly 303*d* to the open position is now described with reference to FIGS. 3 and 4A. It will be understood that the sliding sleeves 314 of the first, second, and third fracturing assemblies 303*a-c* may also be actuated using a similar process. In order to activate the sliding sleeve 314 of the fourth fracturing assembly 303*d*, the frac plug 308*d* (FIG. 4B) may be conveyed into the wellbore 102 for installation at a point downhole from the fracturing assembly 303*d*. The frac plug 308*d* may be conveyed into the wellbore 102 using any suitable conveyance that does not include a perforating gun (or a similar device) for creating perforations in the casing 108 to access the surrounding formation 110. As the frac plug 308*d* traverses the central flow passage 312 of the fracturing assembly 303*d*, the sensor 320 detects a wireless signal generated by the frac plug 308*d*. When the sensor 320 detects the wireless signal, the electronic counter 319 in the electronic module 318 of the fracturing assembly 303*d* registers a count. For example, the electronic counter 319 may initially be at zero and, when the sensor 320 detects the wireless signal, the electronic counter 319 may increment its count by one.

A count is also programmed in the memory 321 of the electronic module 318 of the fracturing assembly 303*d*. The programmed count is based on the number of frac plugs 308 that traverse a particular fracturing assembly 303*a-d*. For example, since the fourth fracturing assembly 303*d* is the bottom-most fracturing assembly in the wellbore 102, only the frac plug 308*d* traverses therethrough, and, therefore, the memory 321 in the electronic module 318 of the fracturing assembly 303*d* may be programmed with a count of one. Similarly, the third fracturing assembly 303*c* will be programmed with a count of two, since two frac plugs 308*d* and 308*c* will traverse therethrough. For similar reasons, the second fracturing assembly 303*b* will be programmed with a count of three since three frac plugs 308*d*, 308*c*, and 308*b* will traverse therethrough and the first fracturing assembly 303*a* will be programmed with the count of four since four frac plugs 308*d*, 308*c*, 308*b*, and 308*a* will traverse therethrough.

In some embodiments, when the electronic module 318 determines that the count registered by the electronic counter 319 is equal to the count programmed in the memory 321, the electronics module 318 may send a command signal to actuate (operate) the actuator 317 and thereby cause the sliding sleeve 314 to move to the open position and thereby expose the flow ports 316. In the illustrated example, the actuator 317 includes a piercing member 322 configured to pierce a pressure barrier 324 that initially separates a first chamber 326*a* and a second chamber 326*b* defined in the housing 301. The piercing member 322 can be driven by any means, such as by an electrical, hydraulic, mechanical, explosive, chemical or other type of actuator. When the command signal is received by the actuator 317, the piercing member 322 pierces the pressure barrier 324, and a support fluid 328 (e.g., oil) flows from the first chamber 326*a* to the second chamber 326*b*, which generates a pressure differential across the sliding sleeve 314. The generated pressure differential urges the sliding sleeve 314 to move (displace) toward the open position. In some embodiments, the pressure differential may be sufficient to fully displace the sliding sleeve 314 downward (i.e., to the right in FIG. 4A) to its open position. In other embodiments, however, it may be required to pressurize the central flow passage 312 to move the sliding sleeve 314 fully to its open position.

In FIG. 4B, the actuator 317 is shown actuated as the piercing member 324 has pierced the pressure barrier 324 such that an amount of the support fluid 328 in the first chamber 326*a* is able to escape into the second chamber 326*b*. The support fluid 328 entering the second chamber 326*b* generates a pressure differential across the sliding sleeve 314 that urges the sliding sleeve 314 to displace downward (to the right in FIG. 4B) and expose the flow ports 316 to establish fluid communication between the annulus 124 and the central flow passage 312.

After passing through the fracturing assembly 303*d*, the frac plug 308*d* will be advanced to a predetermined location and set and anchored within the wellbore, as generally described above. A wellbore projectile (not shown) may be subsequently pumped into the wellbore 102 and received by the frac plug 308*d* to enable pressurization of the central flow passage 312.

FIG. 4C illustrates the wellbore projectile 311 being conveyed (pumped) downhole through the central flow passage 312 and through the fracturing assembly 303*d* to locate and be received by the frac plug 308*d* (FIG. 4B). While depicted in FIG. 4C as a ball, the wellbore projectile 311 may alternatively comprise a dart, a plug, or any other device designed to be received by the frac plug 308*d*. Upon being received by the frac plug 308*d*, the wellbore projectile 311 provides a sealed interface that isolates portions of the wellbore 102 downhole from the set frac plug 308*d*. At this point, the central flow passage 312 may be pressurized with a fluid 330 to be injected into the annulus 124 via the exposed flow ports 316 at an elevated pressure. The fluid 330 may comprise, for example, a fracturing fluid used to create a network of fractures 120 (FIG. 1) in the surrounding formation 110 (FIG. 1) during a hydraulic fracturing operation. Alternatively, or in addition thereto, the fluid 330 may comprise a gravel slurry used to fill the annulus 124 (FIG. 3) during a gravel packing operation.

In some embodiments, the electronic module 318 may include a timer 323. The timer 323 may be a count up timer or a countdown timer and may be programmed with a predetermined time period for actuating the actuator 317. The time period indicates the delay between determining that the registered count and the stored count are the same, and the actuation of the actuator 317. Upon expiration of the predetermined time period, the electronics module 318 may send the command signal to actuate (operate) the actuator 317 and thereby cause the sliding sleeve 314 to move to the open position and expose the flow ports 316.

The predetermined time period may provide sufficient time to set the frac plug 308*d* at a predetermined location below (downhole from) the fracturing assembly 303*d*. The predetermined time period may also provide sufficient time to detach and retrieve the conveyance used for conveying the frac plug 308*d* to the surface location and subsequently pump the wellbore projectile 311 into the wellbore 102 and land the wellbore projectile in the frac plug 308*d*. The predetermined time period may be about 30 minutes, about 1 hour, about 2 hours, or any other desired time period. However, in other embodiments, the predetermined time period may be zero and the actuator 317 may be actuated without any time delay. It will be appreciated that, although the time period may be zero, there will be some time delay before the actuator 317 is actuated. This delay may be due to the circuit latency, signal processing delays, delay in actuating the components associated with actuator 317, etc.

It will thus be understood that the installation of the frac plug 308*d* is immediately followed by the hydraulic fracturing operations in the surrounding formation 110. Herein, "immediately" means that a perforation (or similar) process used in the traditional "plug and perf" operation is not performed prior to conducting the hydraulic fracturing operations. However, "immediately" should not be understood to mean that there is no time delay between the setting of the frac plug 308*d* and the hydraulic fracturing operations. Similarly, "immediately" should not be understood to mean that there is no other operation performed in the wellbore after the installation of the frac plug 308*d*. One or more other operations except for the perforation (or similar) process may be performed in the wellbore. For example, one or more operations to land the wellbore projectile on the frac plug 308*d* may be performed after the frac plug 308*d* has been installed.

In an embodiment, the sensor 320 may comprise a magnetic sensor and one or more magnets (not shown) may be retained in a plurality of recesses 309 (FIG. 4B) defined in the outer surface of the frac plug 308*d*. Similar recesses may be defined in the outer surfaces of the frac plugs 308*a-c*. In other embodiments, however, the magnet(s) of the frac plugs 308*a-d* may be disposed entirely within the frac plugs 308*a-d*, without departing from the scope of the disclosure. In some embodiments, the recesses 309 may be arranged in a desired pattern. Indeed, the magnets may be arranged to provide a magnetic field that extends a predetermined distance from the frac plugs 308*a-d*, and to do so no matter the orientation of the frac plugs 308*a-d*. The pattern may be configured to project the produced magnetic field(s) substantially evenly around the frac plugs 308*a-d*.

If the sensor 320 comprises any other sensor, such as a temperature sensor or an acoustic sensor, then corresponding temperature or noise producing components may be included in the frac plugs 308*a-d*. For instance, if the sensor 320 is a temperature sensor, a heating element may be included in the frac plugs 308*a-d* to increase the temperature around the frac plugs 308*a-d* to a predetermined level that may be detected by the sensor 320. Alternatively, if the sensor 320 is a temperature sensor, then the fluid used to pump the frac plugs 308*a-d* into position may be used to decrease the temperature around the frac plugs 308*a-d* by a predetermined difference that may be detected by the sensor 320. Similarly, if the sensor 320 is an acoustic sensor, a noise generator may be included in the frac plugs 308*a-d* to generate a predetermined acoustic signature that may be detected by the sensor 320. Otherwise, the frac plugs 308*a-d* may be translated within the wellbore and engage the inner wall of the liner 304 (FIG. 3), which may produce noise or vibrations. Strategically moving the frac plugs 308*a-d* so that they engage the inner wall of the liner 304 may result in predetermined acoustic or vibration signals that may be detected with the sensor 320.

In the embodiments disclosed above, it is assumed that a single fracturing assembly 303 is included in a production interval 116*a-d*. However, in other embodiments, two or more fracturing assemblies 303 may be included in one or more production intervals 116. Thus, two or more sliding sleeves 314 may be included in the production intervals 116. In such embodiments, the "cluster" or group of sliding sleeves 314 (including two or more sliding sleeves 314) in a production interval 116 may be actuated to move to the open position using the process described above. In an example, all sliding sleeves 314 in a cluster may be moved simultaneously upon actuation by the wireless signal. In another example, one or more sliding sleeves 314 in a cluster may be moved at different times relative to the other sliding sleeves 314 in the cluster. However, all sliding sleeves 314 may be actuated with the same wireless signal. The sliding sleeves 314 can be actuated to move simultaneously or at different times by controlling one or more of the count programmed in the memory 321, the time period of the timers 323, and the counting intervals of the electronic counters 319. For purposes of discussion herein, simultaneously may mean that the sliding sleeves 314 are moved "at the same time" or within a short delay of each other. The short delay may be due to circuit latency, actuation delays, signal processing delays, and the like.

In other embodiments, in a production interval 116, a traditional "plug and perf" operation may be used for creating the lowermost flow port 316 of the cluster of flow ports 316 in the production interval 116. The flow ports 316 uphole of the lowermost flow port 316 may be exposed by triggering the respective sliding sleeves 314 using the wireless signal, as mentioned above. Such an arrangement allows the upper flow ports 316 to be exposed at a different time than the lowermost flow port 316.

In some embodiments, a digital code may be used to indicate the cluster of sliding sleeves that are to be moved to the open position. In an example, the digital code can include a header, a location address, and a command. The digital code can be a frequency modulation, an amplitude modulation, or a phase modulation of a transmitted signal. The digital code can be transmitted by any of the previously mentioned modes of wireless telemetry including acoustic, vibrational, magnetic, electrical, and electromagnetic waves. The digital code may be stored in an electronic communication device such as an RFID device or an NFC device coupled to the frac plugs 308 and the digital code may be read by the sensor 320 (e.g., a RFID reader or a NFC device) of each fracturing assembly 303. The memory 321 of one or more fracturing assemblies 303 in a production interval 116 may be programmed with the digital code. When the digital code read by the sensor 320 matches the code in the memory 321, the timer 323 of the corresponding fracturing assembly 303 may be triggered. Upon expiration of the predetermined time period in the timer, the actuator 317 causes the sliding sleeve 314 to move to the open position. The time period may be zero or any desired value.

In some examples, all sliding sleeves 314 in the cluster may be opened simultaneously in response to the digital code by programming the same time period in all timers 323 of the sliding sleeves 314 in a cluster. In other examples, only a select group of sliding sleeves 314 in a particular cluster may be opened. The group may include a single sliding sleeve. In still other examples, the sliding sleeves 314 in a cluster may be actuated to open at different times. For instance, a first sliding sleeve in the cluster may open at time T1 after the digital code has been received and a second sliding sleeve in the cluster may open after a time T2 has elapsed after the opening of the first sleeve. In other instances, a first sleeve in the cluster may open at a time T1 after receipt of the digital code and a second sliding sleeve in the cluster may open at a time T2 after a predetermined event occurs (e.g., temperature in the wellbore 102 changes by 150 F) or at a time T3 if no event occurs. The predetermined event may be detected using the sensor 320 or using other device(s) included in the fracturing assembly.

It may be noted that, when a digital code is used to actuate the sliding sleeves 314, the electronic counter 319 may not be required and may thus be omitted from the fracturing assembly 303.

In some embodiments, a confirmation signal may be provided by the fracturing assembly 303 and may acknowledge that the wireless signal was received from the frac plug 308*a-d*. The confirmation signal may be received by the conveyance used to install the frac plug 308*a-d* and may be an acoustic signal, an electromagnetic signal, an RFID signal, a NFC signal, or a combination thereof and may be generated by the electronic module 318. The confirmation signal may be received by a corresponding receiver (not shown) of the setting tool 212.

After the hydraulic fracturing operations have been completed, the frac plugs 308 can be drilled out. For example, a drilling assembly including a drill bit at the distal end thereof is run downhole to drill out all the frac plugs 308 thereby allowing full access to the surrounding formation 110. Alternatively, the frac plugs 308 and the wellbore projectiles landed therein can be made of a degradable material that allows the frac plug 308 to dissolve and thereby clear the completion assembly 302 for subsequent fluid flow through the completion assembly 302. Suitable degradable materials for the frac plugs may be a galvanically-corrodible metal (e.g., gold, gold-platinum alloys, silver, nickel, nickel-copper alloys, nickel-chromium alloys, copper, copper alloys, chromium, tin, aluminum, iron, zinc, magnesium, and beryllium), micro-galvanic metals or materials (e.g., nano-structured matrix galvanic materials, such as a magnesium alloy with iron-coated inclusions), and a degradable polymer (e.g., polyglycolic acid, polylactic acid, and thiol-based plastics).

Figure 5:
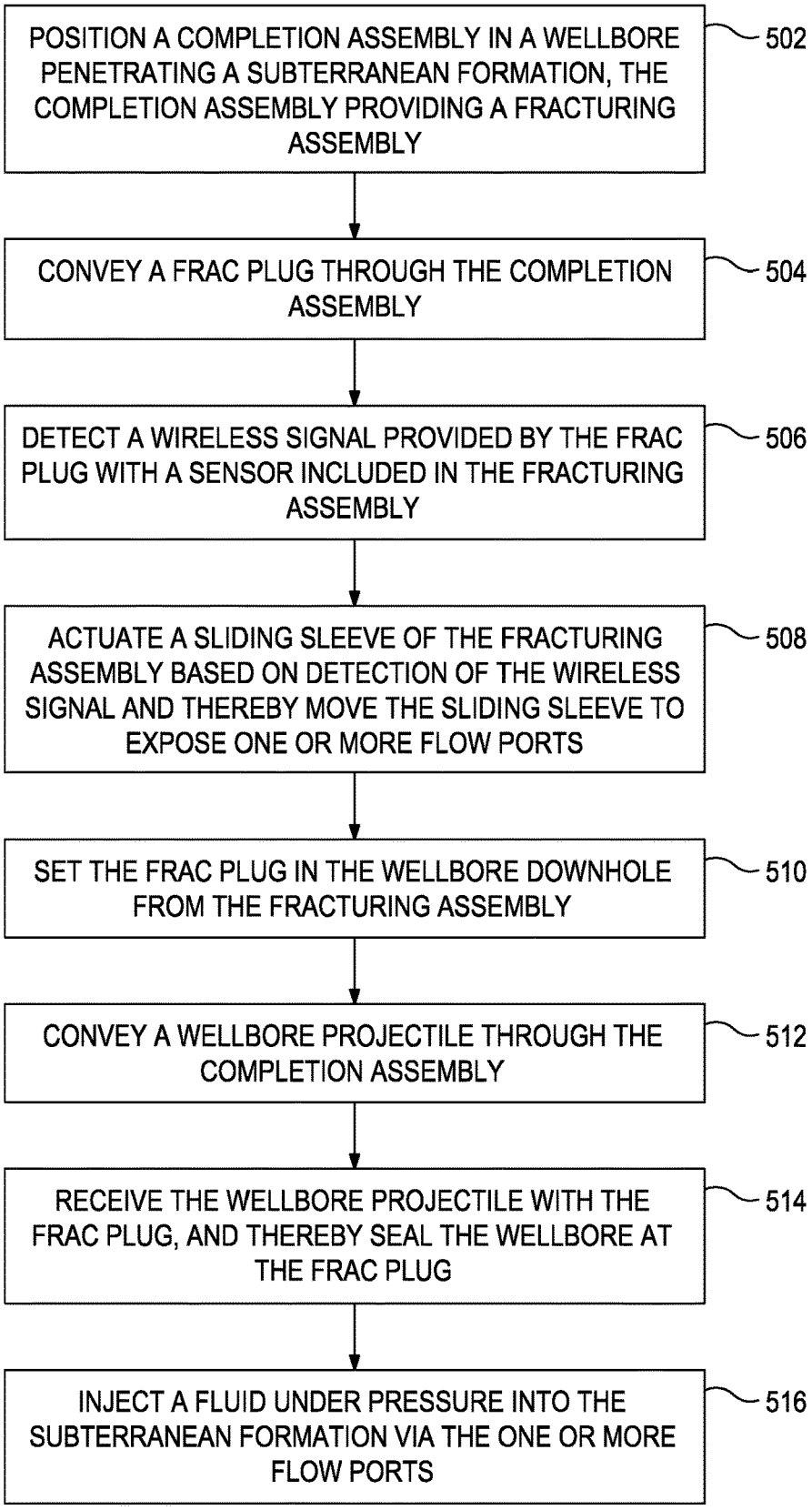
FIG. 5 is a flow chart of a method of performing one or more wellbore operations using the principles of the present disclosure.

FIG. 5 is a flow chart of a method 500, according to one or more embodiments disclosed. As illustrated, the method 500 may include positioning a completion assembly in a wellbore penetrating a subterranean formation, as at 502, and conveying a frac plug through the completion assembly, as at 504. The completion assembly may provide a fracturing assembly. The method 500 may further include detecting a wireless signal provided by the frac plug with a sensor included in the fracturing assembly, as at 506, actuating a sliding sleeve of the fracturing assembly based on detection of the wireless signal and thereby moving the sliding sleeve to expose one or more flow ports, as at 508, setting the frac plug in the wellbore downhole from the fracturing assembly, as at 510, conveying a wellbore projectile through the completion assembly, as at 512, receiving the wellbore projectile with the frac plug, and thereby sealing the wellbore at the frac plug, as at 514, and injecting a fluid under pressure into the subterranean formation via the one or more flow ports, as at 516.

Figure 6:
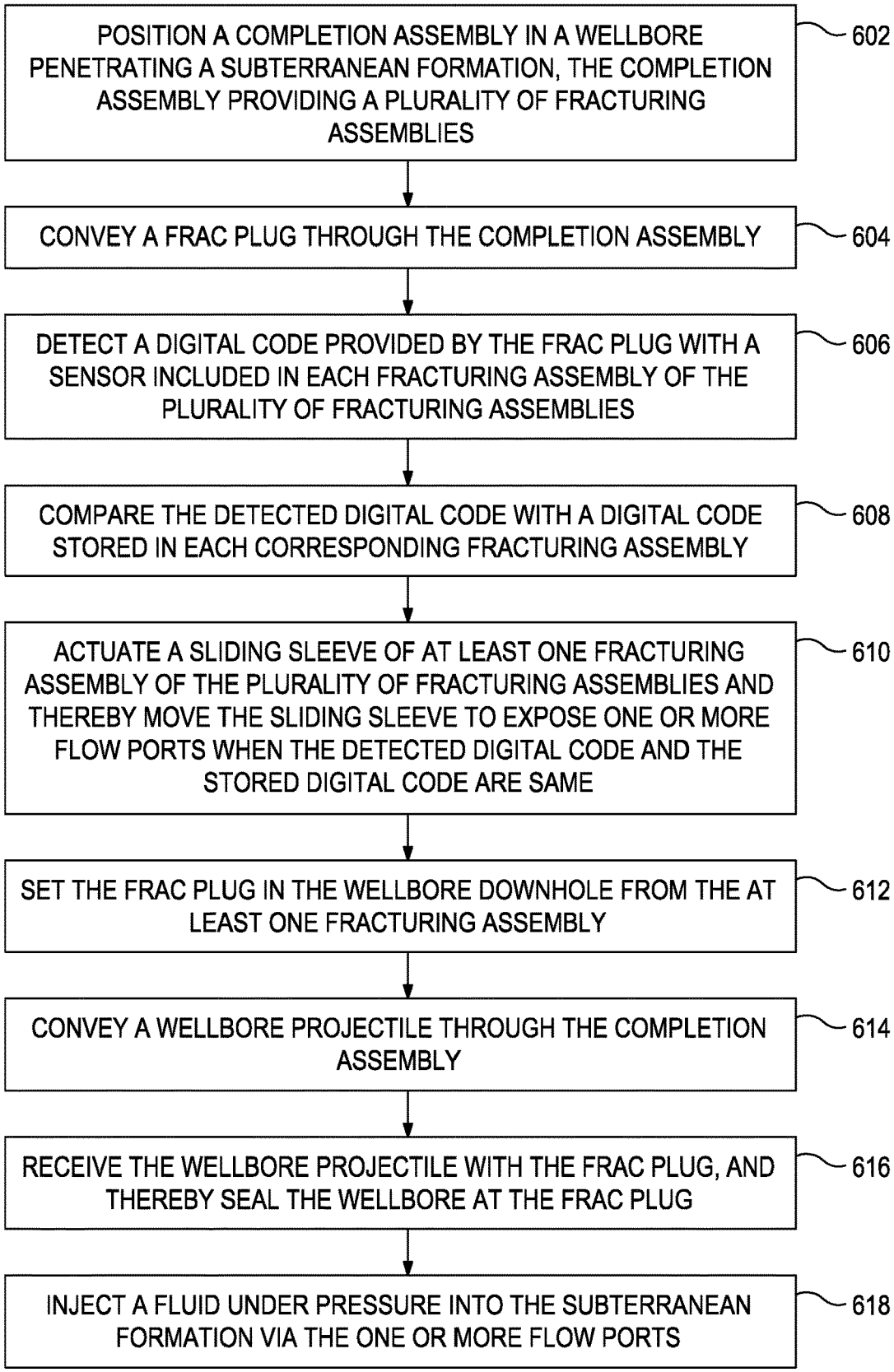
FIG. 6 is a flow chart of another method of performing one or more wellbore operations using the principles of the present disclosure.

FIG. 6 is a flow chart of a method 600, according to one or more embodiments disclosed. As illustrated, the method 600 may include positioning a completion assembly in a wellbore penetrating a subterranean formation, the completion assembly providing a plurality of fracturing assemblies, as at 602, conveying a frac plug through the completion assembly, as at 604, detecting a digital code provided by the frac plug with a sensor included in each fracturing assembly of the plurality of fracturing assemblies, as at 606, comparing the detected digital code with a digital code stored in each corresponding fracturing assembly, as at 608, actuating a sliding sleeve of at least one fracturing assembly of the plurality of fracturing assemblies and thereby moving the sliding sleeve to expose one or more flow ports when the detected digital code and the stored digital code are same, as at 610, setting the frac plug in the wellbore downhole from the at least one fracturing assembly, as at 612, conveying a wellbore projectile through the completion assembly, as at 614, receiving the wellbore projectile with the frac plug, and thereby sealing the wellbore at the frac plug, as at 616, and injecting a fluid under pressure into the subterranean formation via the one or more flow ports, as at 618.

Embodiments Disclosed Herein Include:

A. A method, comprising positioning a completion assembly in a wellbore penetrating a subterranean formation, the completion assembly providing a fracturing assembly; conveying a frac plug through the completion assembly; detecting a wireless signal provided by the frac plug with a sensor included in the fracturing assembly; actuating a sliding sleeve of the fracturing assembly based on detection of the wireless signal and thereby moving the sliding sleeve to expose one or more flow ports; setting the frac plug in the wellbore downhole from the fracturing assembly; conveying a wellbore projectile through the completion assembly; receiving the wellbore projectile with the frac plug, and thereby sealing the wellbore at the frac plug; and injecting a fluid under pressure into the subterranean formation via the one or more flow ports.

B. A method, comprising positioning a completion assembly in a wellbore penetrating a subterranean formation, the completion assembly providing a plurality of fracturing assemblies; conveying a frac plug through the completion assembly; detecting a digital code provided by the frac plug with a sensor included in each fracturing assembly of the plurality of fracturing assemblies; comparing the detected digital code with a digital code stored in each corresponding fracturing assembly; actuating a sliding sleeve of at least one fracturing assembly of the plurality of fracturing assemblies and thereby moving the sliding sleeve to expose one or more flow ports when the detected digital code and the stored digital code are same; setting the frac plug in the wellbore downhole from the at least one fracturing assembly; conveying a wellbore projectile through the completion assembly; receiving the wellbore projectile with the frac plug, and thereby sealing the wellbore at the frac plug; and injecting a fluid under pressure into the subterranean formation via the one or more flow ports.

C. A system, comprising a completion assembly positioned in a wellbore penetrating a subterranean formation; a fracturing assembly provided by the completion assembly, the fracturing assembly comprising a sliding sleeve that is actuated to move to an open position based on a wireless signal detected in the wellbore; a sensor that detects the wireless signal; a counter that registers a count when the wireless signal is detected; and an electronics module that compares the registered count with a count stored in the fracturing assembly; a frac plug that communicates the wireless signal and is secured in the wellbore downhole from the fracturing assembly; and a wellbore projectile receivable by the frac plug to seal the wellbore at the frac plug and thereby isolate portions of the wellbore downhole from the frac plug.

Each of embodiments A, B, and C may have one or more of the following additional elements in any combination: Element 1: wherein actuating the sliding sleeve comprises registering a count in the fracturing assembly when the wireless signal is detected; comparing the registered count with a count stored in the fracturing assembly; and moving the sliding sleeve to expose one or more flow ports when the registered count and the stored count are same.

Element 2: wherein the fracturing assembly includes a timer programmed with a predetermined time period, and wherein actuating the sliding sleeve comprises: triggering operation of the timer upon detection of the wireless signal; and actuating the sliding sleeve upon expiration of the predetermined time period. Element 3: wherein injecting the fluid under pressure into the subterranean formation further comprises injecting the fluid immediately after setting the frac plug. Element 4: wherein the wireless signal comprises a digital code, the completion assembly provides at least two fracturing assemblies, and the method further comprises: detecting the digital code provided by the frac plug with the at least two fracturing assemblies; comparing the digital code detected with the at least two fracturing assemblies with a digital code stored in a corresponding fracturing assembly of the at least two fracturing assemblies; actuating the sliding sleeves of the at least two fracturing assemblies and thereby expose one or more flow ports when the detected digital code and the stored digital code are the same; setting the frac plug in the wellbore downhole from the at least two fracturing assemblies; and injecting fluid under pressure into the subterranean formation via the one or more flow ports. Element 5: wherein actuating the sliding sleeves further comprises moving the sliding sleeves simultaneously to expose the one or more flow ports. Element 6: wherein actuating the sliding sleeves further comprises moving the sliding sleeves at different times to expose the one or more flow ports. Element 7: further comprising transmitting a confirmation signal with the fracturing assembly to indicate receipt of the wireless signal from the frac plug. Element 8: further comprising drilling out the frac plug after one or more wellbore operations are completed. Element 9: wherein the frac plug is made of a degradable material, the method further comprising allowing the frac plug to degrade following one or more wellbore operations. Element 10: wherein the wireless signal is one of a magnetic signal, an electromagnetic signal, a temperature signal, and an acoustic signal.

Element 11: wherein the completion assembly defines at least one production interval in the wellbore, and at least two fracturing assemblies of the plurality of fracturing assemblies are positioned in the at least one production interval and the method further comprises actuating the sliding sleeves of the at least two fracturing assemblies simultaneously. Element 12: wherein the completion assembly defines at least one production interval in the wellbore, and at least two fracturing assemblies of the plurality of fracturing assemblies are positioned in the at least one production interval and the method further comprises actuating the sliding sleeves of the at least two fracturing assemblies at different times. Element 13: wherein transmitting a digital code comprises transmitting a digital code using at least one of an RFID device and an NFC device. Element 14: wherein injecting the fluid under pressure into the subterranean formation further comprises injecting the fluid immediately after setting the frac plug.

Element 15: wherein the sliding sleeve is actuated to move to the open position when the registered count and the stored count are same. Element 16: further comprising a timer programmed with a predetermined time period, wherein an operation of the timer is triggered upon detection of the wireless signal and the sliding sleeve is actuated upon expiration of the predetermined time period. Element 17: further comprising two or more fracturing assemblies, wherein the sliding sleeves of the two or more fracturing assemblies are actuated simultaneously. Element 18: further comprising two or more fracturing assemblies, wherein the sliding sleeves of the two or more fracturing assemblies are actuated at different times.

By way of non-limiting example, exemplary combinations applicable to embodiment A includes: Element 4 with Element 5, and Element 4 with Element 6.

Therefore, the present disclosure is well adapted to attain the ends and advantages mentioned as well as those that are inherent therein. The embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The embodiments illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. A method, comprising:

positioning a completion assembly in a wellbore penetrating a subterranean formation, the completion assembly providing a fracturing assembly;

conveying a frac plug through the completion assembly;

detecting a wireless signal provided by the frac plug with a sensor included in the fracturing assembly;

detecting the digital code provided by the frac plug with the fracturing assembly;

comparing the digital code detected with the fracturing assembly with a stored digital code;

actuating a sliding sleeve of the fracturing assembly based on detection of the wireless signal and thereby moving the sliding sleeve to expose one or more flow ports;

setting the frac plug in the wellbore downhole from the fracturing assembly;

after setting the frac plug in the wellbore, conveying a wellbore projectile through the completion assembly;

receiving the wellbore projectile by the frac plug, and thereby sealing the wellbore at the frac plug; and injecting a fluid under pressure into the subterranean formation via the one or more flow ports;

wherein the fracturing assembly includes a timer programmed with a predetermined time period, and wherein the step of actuating the sliding sleeve comprises:

triggering operation of the timer after comparing the digital code; and actuating the sliding sleeve upon expiration of the predetermined time period by sending the command.

2. The method of claim 1, wherein actuating the sliding sleeve comprises:

registering a count in the fracturing assembly when the wireless signal is detected;

comparing the registered count with a count stored in the fracturing assembly; and moving the sliding sleeve to expose the one or more flow ports when the registered count and the stored count are same.

3. The method of claim 1, wherein injecting the fluid under pressure into the subterranean formation further comprises injecting the fluid after setting the frac plug.

4. The method of claim 1, wherein actuating the sliding sleeves further comprises moving the sliding sleeves simultaneously to expose the one or more flow ports.

5. The method of claim 1, wherein actuating the sliding sleeves further comprises moving the sliding sleeves at different times to expose the one or more flow ports.

6. The method of claim 1, further comprising transmitting a confirmation signal with the fracturing assembly to indicate receipt of the wireless signal from the frac plug.

7. The method of claim 1, further comprising drilling out the frac plug after one or more wellbore operations are completed.

8. The method of claim 1, wherein the frac plug is made of a degradable material, the method further comprising allowing the frac plug to degrade following one or more wellbore operations.

9. The method of claim 1, wherein the wireless signal is one of a magnetic signal, an electromagnetic signal, a temperature signal, or an acoustic signal.

10. A method, comprising:

positioning a completion assembly in a wellbore penetrating a subterranean formation, the completion assembly providing a plurality of fracturing assemblies;

conveying a frac plug through the completion assembly;

detecting a digital code provided by the frac plug with a sensor included in each fracturing assembly of the plurality of fracturing assemblies;

comparing the detected digital code with a digital code stored in each corresponding fracturing assembly;

actuating a sliding sleeve of at least one fracturing assembly of the plurality of fracturing assemblies by sending the digital code and thereby moving the sliding sleeve to expose one or more flow ports when the detected digital code and the stored digital code are same;

setting the frac plug in the wellbore downhole from the at least one fracturing assembly;

after setting the frac plug in the wellbore, conveying a wellbore projectile through the completion assembly;

receiving the wellbore projectile by the frac plug, and thereby sealing the wellbore at the frac plug; and injecting a fluid under pressure into the subterranean formation via the one or more flow ports;

wherein the completion assembly defines at least one production interval in the wellbore, and at least two fracturing assemblies of the plurality of fracturing assemblies are positioned in the at least one production interval.

11. The method of claim 10, further comprising actuating sliding sleeves of the at least two fracturing assemblies simultaneously.

12. The method of claim 10, further comprising actuating sliding sleeves of the at least two fracturing assemblies at different times.

13. The method of claim 10, wherein transmitting a digital code comprises transmitting a digital code using at least one of an RFID device or an NFC device.

14. The method of claim 10, wherein injecting the fluid under pressure into the subterranean formation further comprises injecting the fluid immediately after setting the frac plug.

15. A system, comprising:

a completion assembly positioned in a wellbore penetrating a subterranean formation;

fracturing assemblies provided by the completion assembly, each fracturing assembly comprising:

a sliding sleeve that is actuated to move to an open position based on a wireless signal detected in the wellbore; and a sensor that detects the wireless signal;

at least one fracturing assembly comprising:

at least one selected from a group consisting of a counter that registers a count when the wireless signal is detected and a timer programmed with a predetermined time period; and an electronics module that compares the registered count with a count stored in the at least one fracturing assembly or triggers the timer upon detecting the wireless signal having the digital code, wherein the electronics module controls actuation of the sliding sleeve based on the predetermined time period and the command;

a frac plug that communicates the wireless signal and is secured in the wellbore downhole from the fracturing assembly; and a wellbore projectile receivable by the frac plug to seal the wellbore at the frac plug and thereby isolate portions of the wellbore downhole from the frac plug.

16. The system of claim 15, wherein the sliding sleeve is actuated to move to the open position when the registered count and the stored count are same.

17. The system of claim 15, wherein each sliding sleeve of two or more fracturing assemblies are actuated simultaneously.

18. The system of claim 15, wherein each sliding sleeve of two or more fracturing assemblies are actuated at different times.

19. The system of claim 15, wherein the sensor is an RFID device or an NFC device.

20. The system of claim 15, wherein the frac plug is made of a degradable material and comprises an RFID device or an NFC device.

* * * * *